US005644110A

United States Patent [19]

Bahjat et al.

[11] Patent Number: 5,644,110

[45] Date of Patent: Jul. 1, 1997

[54] ELEVATOR SERVICE FOR DUAL LOBBY DURING UP-PEAK

[75] Inventors: Zuhair S. Bahjat; James M. Collins, both of Farmington; David M. Hughes, New Britain, all of Conn.

[73] Assignee: Otis Elevator Company, Farmington, Conn.

[21] Appl. No.: 357,630

[22] Filed: Dec. 16, 1994

[51] Int. Cl.[6] ..... B66B 1/28

[52] U.S. Cl. ..... 187/385; 187/392; 187/316; 187/383

[58] Field of Search ..... 187/902, 383, 187/385, 386, 388, 387, 316, 392

[56] References Cited

U.S. PATENT DOCUMENTS

| | | | |
|---|---|---|---|
| 2,998,866 | 9/1961 | Dinning | 187/29 |
| 3,307,657 | 3/1967 | Burgy et al. | 187/29 |
| 4,084,661 | 4/1978 | Quan | 187/29 R |
| 4,129,199 | 12/1978 | MacDonald | 187/29 R |
| 4,303,851 | 12/1981 | Mottier | 235/92 PK |
| 4,323,142 | 4/1982 | Bittar | 187/29 R |
| 4,330,836 | 5/1982 | Donofrio et al. | 364/567 |
| 4,357,997 | 11/1982 | Husson et al. | 187/29 R |
| 4,363,381 | 12/1982 | Bittar | 187/29 R |
| 4,708,224 | 11/1987 | Schroider et al. | 187/122 |
| 4,792,019 | 12/1988 | Bittar et al. | 187/125 |
| 4,804,069 | 2/1989 | Bittar et al. | 187/125 |
| 4,846,311 | 7/1989 | Thangavelu | 187/125 |
| 5,092,430 | 3/1992 | Goto et al. | 187/122 |
| 5,183,981 | 2/1993 | Thangavelu | 187/128 |
| 5,202,540 | 4/1993 | Auer et al. | 187/101 |
| 5,300,739 | 4/1994 | Bittar et al. | 187/127 |
| 5,345,049 | 9/1994 | Bajat et al. | 187/127 |

FOREIGN PATENT DOCUMENTS

| | | | |
|---|---|---|---|
| 2270187 | 12/1975 | France | B66B 1/20 |

OTHER PUBLICATIONS

European Search Report, dated 5 Sep. 1996.

*Primary Examiner*—Robert Nappi
*Attorney, Agent, or Firm*—Joseph P. Abate

[57] ABSTRACT

An elevator system for up-peak servicing of a building having a dual lobby. The system includes a controller having an electronic processor coupled to a memory; a plurality of elevator cars controllably connected to the controller, a dual lobby routine stored within the memory, the dual lobby routine includes instructions for dispatching at least one of the elevator cars to a lower lobby during up-peak, indicating a sector assigned to the car, nudging (if needed) the car if a lower lobby time-out is exceeded, dispatching the car to the upper lobby if a load weight threshold is not exceeded, and then indicating the sector assigned to the car while the car is located at the upper lobby.

1 Claim, 13 Drawing Sheets

MACHINE ROOM
MAIN FLOOR (LOBBY) "L"
SN=3
SN=2
SN=1
13
10
9
6
5
2
FROM 40
PL
32
GROUP CONTROL
CPU
POS...CC
DRIVE & MOTION CONTROL
CPU
30
HC
LW
SI
CC
12
14
16
18
U
D
10-13
6-9
2-5
1
2
3
4

DUAL LOBBY SERVICE WITH FIXED NUMBER OF CARS

UPON ACTIVATION OF MIT, A FIXED NUMBER OF CARS WILL BE ASSIGNED TO SERVE THE LOWER LOBBY AND THE UPPER LOBBY. THE NUMBER OF CARS DEDICATED TO EACH LOBBY DURING MIT OPERATION CAN BE PROGRAMMABLE. AS AN EXAMPLE, WITH A 6 CAR GROUP, 3 CARS CAN BE DESIGNATED TO SERVE THE LOWER LOBBY AND 3 CARS CAN BE DESIGNATED TO SERVE THE UPPER LOBBY.

DUAL LOBBY SERVICE WITH VARIABLE NUMBER OF CARS

UPON ACTIVATION OF MIT, THE NUMBER OF CARS WOULD BE DIVIDED EQUALLY BETWEEN LOBBIES. IF THE NUMBER OF CARS AVAILABLE IN THE GROUP IS ODD, THE ADDITIONAL CAR CAN BE DISPATCHED TO THE LOBBY WHICH TRIGGERED MIT. AFTER THE APPROPRIATE CARS HAVE BEEN DISPATCHED TO THEIR DESIGNATED LOBBIES, TRAFFIC INTENSITY AT EACH LOBBY WILL BE MEASURED. AT SPECIFIC TIME INTERVALS, THE TRAFFIC INTENSITY WILL BE CONTINUOUSLY EVALUATED AND THE NUMBER OF CARS AT EACH LOBBY WILL BE ADJUSTED BASED ON THE GIVEN THRESHOLDS. THE FOLLOWING TABLE SPECIFIES THE ACTION TAKEN BASED ON THE TRAFFIC INTENSITY AT EACH LOBBY.

| LOWER LOBBY (LL) TRAFFIC INTENSITY | UPPER LOBBY (UL) TRAFFIC INTENSITY | ACTION |
|---|---|---|
| INCREASED | DECREASED | MOVE 1 CAR FROM UL TO LL |
| INCREASED | INCREASED | ENSURE BOTH LOBBIES HAVE EQUAL NUMBER OF CARS. IF ODD CAR REMAINING, DISPATCH ODD CAR TO LOBBY WITH GREATEST TRAFFIC INTENSITY |
| DECREASED | INCREASED | MOVE 1 CAR FROM LL TO UL |
| DECREASED | DECREASED | NO CHANGE |

AS A GENERAL RULE, THERE MUST BE A MINIMUM OF 2 CARS TO SERVE EACH LOBBY.

DURING MIT OPERATION, THE MIT FUNCTIONS AT EACH LOBBY WILL BE INDEPENDENT OF EACH OTHER. THIS INCLUDES THE CHOOSING AND DISPATCHING OF THE SELECTED CAR. IT SHOULD ALSO BE POINTED OUT THAT BOTH LOBBIES WOULD SERVE THE ENTIRE BUILDING WITH THE FOLLOWING EXCEPTION. CARS WHICH ARE DESIGNATED TO THE LOWER LOBBY WILL ONLY STOP AT THE UPPER LOBBY FOR A CAR CALL ONLY. CARS FROM THE LOWER LOBBY WHICH STOP AT THE UPPER LOBBY FOR CAR CALLS WILL NOT BE CONSIDERED AS PART OF THE UPPER LOBBY'S MIT GROUP.

FIG. 5A

ELEVATOR SERVICE FOR DUAL LOBBY DURING UP-PEAK

BACKGROUND OF THE INVENTION

1. Technical Field

The present is directed to elevator dispatching, and more particularly, to optimizing channeling in which floors above the main floor or lobby during up-peak are grouped into sectors, with each sector including a set of contiguous floors and with each sector assigned to a car.

2. Description of the Prior Art

Elevator performance throughout the morning up-peak period is measured, among other criteria, by the speed in which people are moved from the lobby to their respective landings within the building. The time spent by a passenger during a typical up-peak run can be broken into two major phases: waiting time at the lobby and service time to their landing.

During the up-peak period, when two cars leave the lobby partially loaded within a predetermined period of time, the elevator dispatching system typically recalls all elevator cars to the lobby to handle traffic in-coming from the lobby. Hence, a well-known channeling operation is typically activated.

Well-known electronic computer implemented dispatching routines such as channeling enhance elevator system performance during up-peak by reducing the service time for each passenger, while having a minimal effect on the waiting time at the lobby. This enhancement is accomplished by grouping passengers going to the same general area of the building into the same car. Floors above the lobby are divided into sectors. When a car is approaching the lobby, the channeling routine chooses a sector for the car so that the car will only serve floors contained within that sector. The service time (and round trip time) of the car is decreased because of the smaller number of landings being served by the car. See, for example, known channeling routines and implementations disclosed and described in U.S. Pat. No. 4,792,019, Contiguous Floor Channeling With Up Hall Call Elevator Dispatching, Issued Dec. 20, 1988; U.S. Pat. No. 4,804,069, Contiguous Floor Channeling Elevator Dispatching, Issued Feb. 14, 1989; U.S. Pat. No. 4,846,311, Optimized "Up-Peak" Elevator Channeling System With Predicted Traffic Volume Equalized Sector Assignments, and U.S. Pat. No. 5,183,981, "Up-Peak" 0 Elevator Channeling System With Optimized Preferential Service To High Intensity Traffic Floors, which are all hereby incorporated in their entireties by reference.

During one known channeling operation, a group controller or an operational control sub-system divides a building into sectors. The number of sectors is equal to the number of cars in operation (or service) minus one. The size of each sector includes an equal number of floors being served.

The '019 patent teaches a typical channeling routine as shown, for example, in FIGS. 2A–2C herein, which correspond to FIGS. 2A–2C of U.S. '019. Four elevator cars 1–4 which are part of a group elevator system, serve a building having a plurality of floors, e.g. 13, above a lobby; see FIG. 1 herein which corresponds to FIG. 1 of '019. Each car 1–4, contains a car operating panel 12 through which a passenger makes a car call to a floor by pressing a button, producing a signal (CC) identifying the floor to which the passenger intends to travel. On each of the floors, there is a hall fixture 14 through which a hall call signal (HC) is provided to indicate the intended direction of travel by a passenger on the floor. At the lobby (L), there is also a hall call fixture 16 through which a passenger calls the car to the lobby. The depiction in FIG. 1 illustrates cars selected during an up-peak period at which time the floors 2–13, above the main floor, are divided into three sectors, each sector containing four floors. Each of the sectors, which are contiguous, is served by only one of the four cars 1–4 at any time. Such channeling operation is explained in more detail in the flow charts of FIGS. 2A–2C, steps S1–S31, all as shown, described and well-known from U.S. Pat. No. 4,792,019, previously incorporated in its entirety by reference. As shown in FIG. 1, one car, e.g. car 1, is left free. Each car 1–4 will only respond to car calls that are made in the car from the lobby to floors that coincide with the floors in the sector assigned to the car. The car 4, for instance, responds only to car calls made at the lobby to floors 10–13.

The present inventors believe that known channeling routines operate from only one lobby. An adjacent floor to the lobby, such as a subway entrance below the lobby, with heavy up-peak traffic might have long waiting times as the up-peak traffic might not be properly served in, e.g., a dual lobby building having an upper lobby (UL) and a lower lobby (LL). Elevator systems which service a building having a lobby, basement and sub-basement are known; see, e.g., U.S. Pat. No. 4,357,997, Husson et al., Nov. 9, 1982.

SUMMARY OF THE INVENTION

The present inventors believe that improvements in elevator service in buildings having dual lobbies can be achieved by employing an elevator system including a controller having an electronic processor coupled to a memory, and a dual lobby routine stored within the memory. The dual lobby routine of the present invention includes instructions for dispatching an elevator car to a lower lobby during up-peak, indicating a sector assigned to the car, nudging (if needed) the elevator car if either a lower lobby dispatching time-out, a particular load weight threshold or a lower lobby demand time-out is exceeded, dispatching the elevator car to the upper lobby if a second load weight threshold is not exceeded or if a car call in the car is requested for the upper lobby, and then indicating the sector assigned to the elevator while the car is disposed or located at the upper lobby.

The elevator system of the present invention serves both lobbies simultaneously. When an elevator car returns from an up-peak run, the car will assign itself to a sector and stop at the lower lobby. After a period of time, the car is dispatched to the upper lobby to handle the additional up-peak traffic for the same sector.

Accordingly, it is a principal object of the present invention to increase overall elevator system performance.

It is an additional object of the present invention to increase elevator system performance during up-peak periods.

It is a still further object of the present invention to service dual lobbies efficiently within a building.

Further and still other objects of the present invention will become more readily apparent in view of the following detailed description when taken in conjunction with the following drawing, in which:

BRIEF DESCRIPTION OF THE DRAWING

FIG. 5A is a chart with explanatory legends describing a first alternative dual lobby routine according to the invention, while

DETAILED DESCRIPTION OF THE PREFERRED EMBODIMENTS AND BEST MODE

Figure 1:
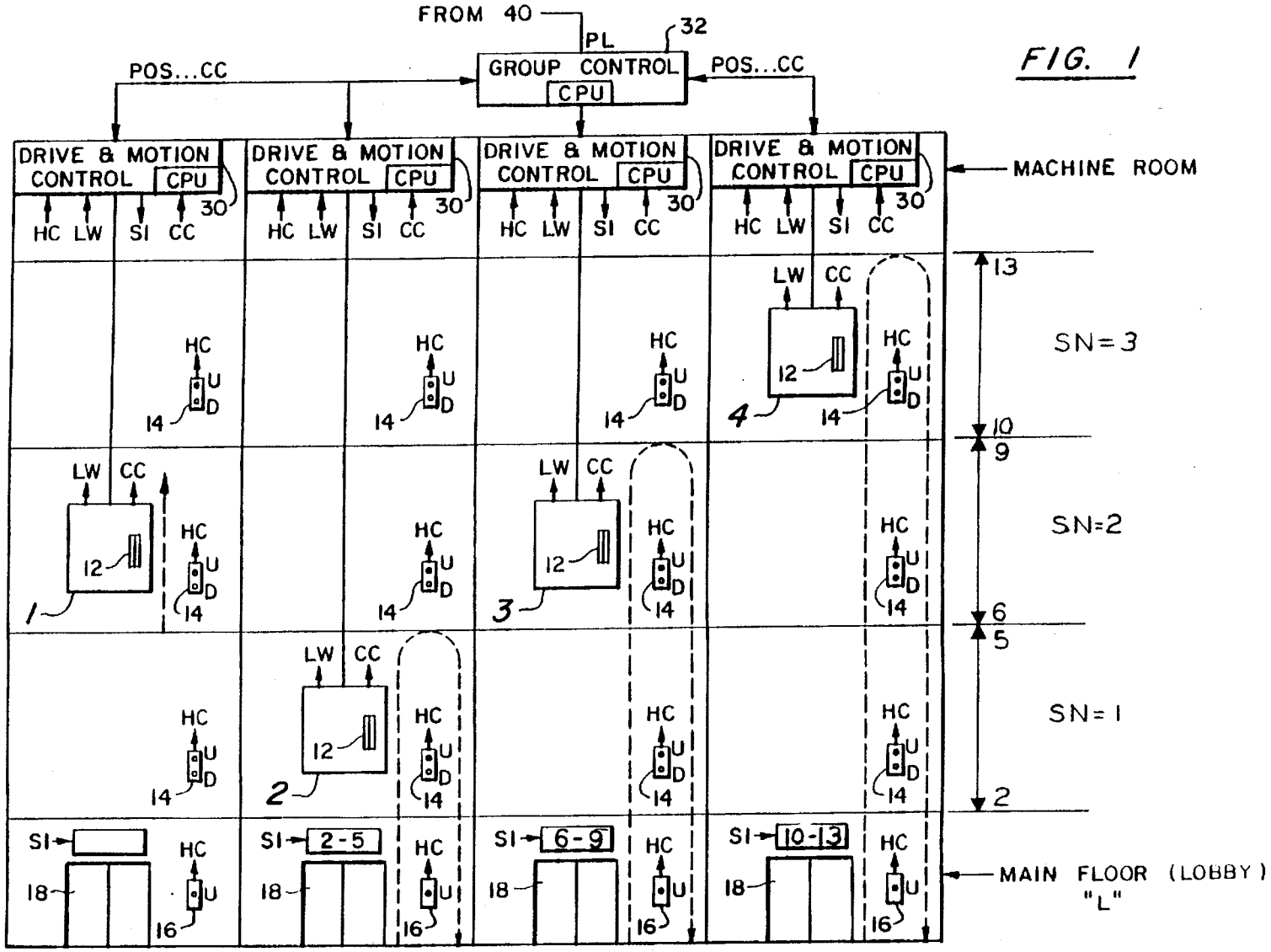
FIG. 1 is a functional block diagram of an elevator system comprising a four car group serving 12 floors above a single lobby.
Figure 2A:
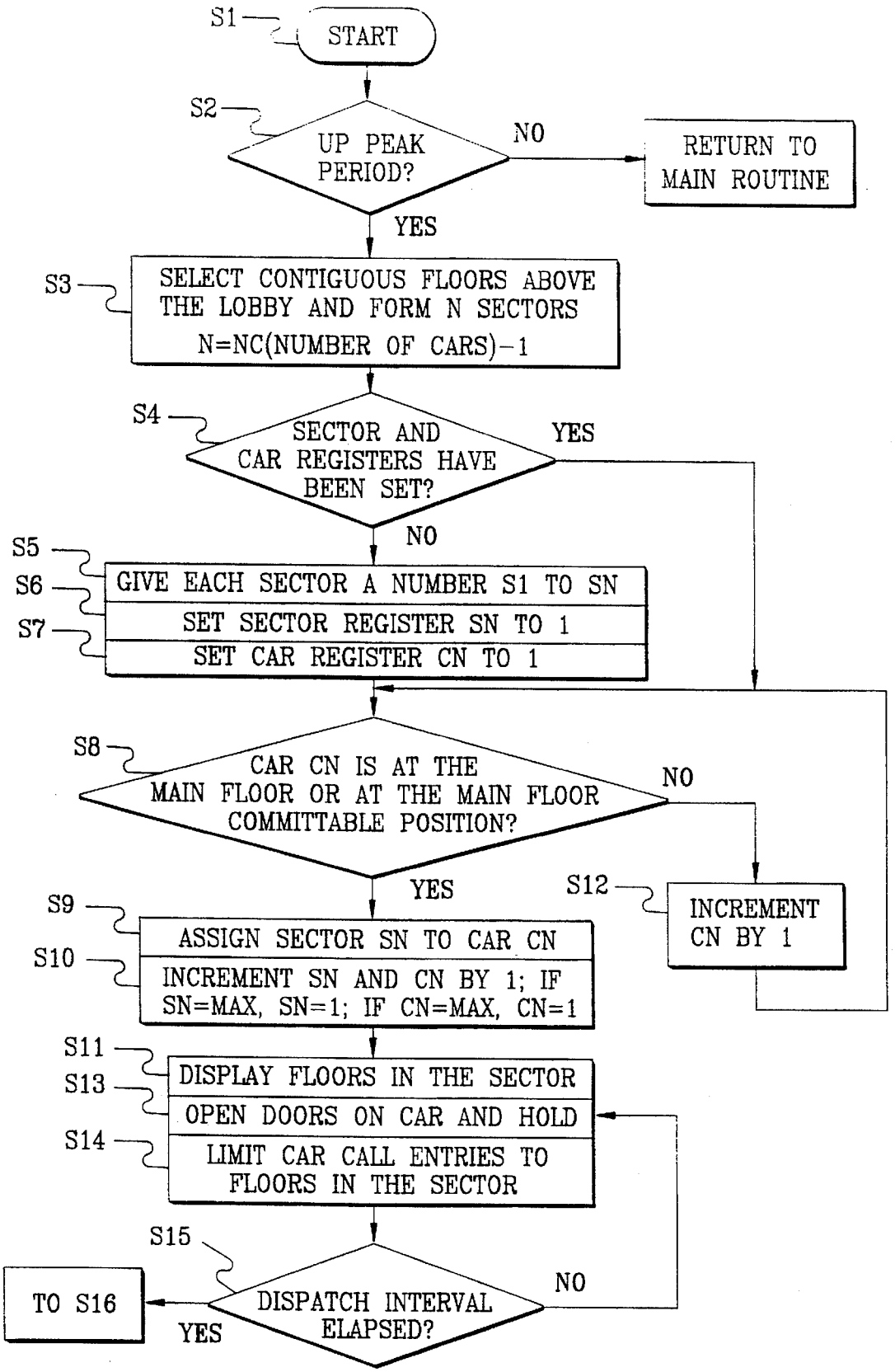
FIG. 2A (PRIOR ART)
FIGS. 2A–2C are flow diagrams which show a known channeling routine which is employed during an up-peak period.
Figure 2B:
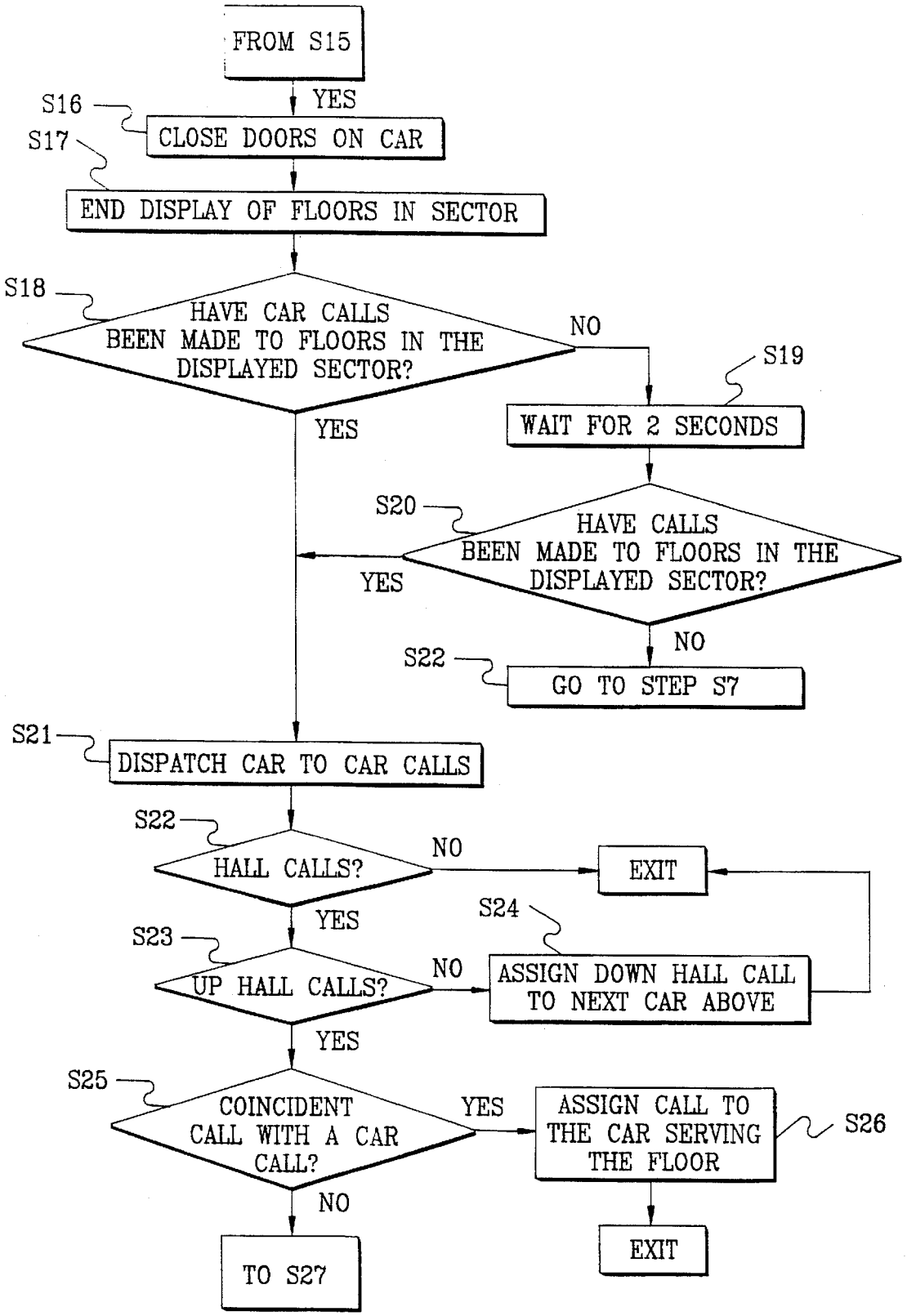
FIG. 2B (PRIOR ART)
Figure 2C:
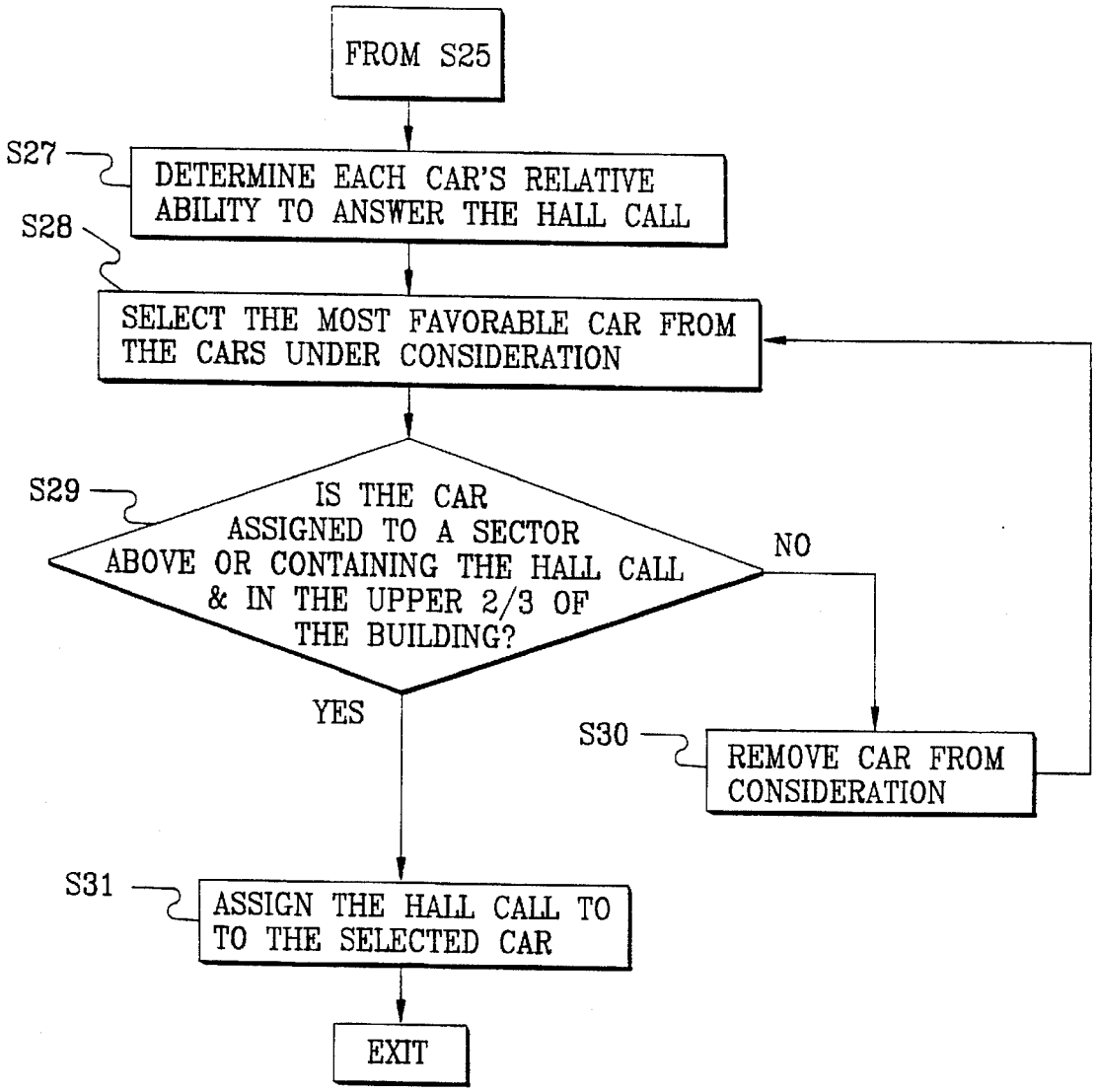
FIG. 2C (PRIOR ART)

In FIG. 1, four elevator cars 1–4, which form part of a group elevator system, serve a building having a plurality (e.g., 13) of floors. Each car 1–4 contains a car operating panel 12 through which a passenger makes a car call to a floor by pressing a button producing a signal CC identifying the floor to which the passenger intends to travel. On each of the floors, there is a hall fixture 14 through which a hall call signal HC is provided to indicate the intended direction of travel by a passenger on the floor. At the lobby L, there is a hall call fixture 16 through which a passenger calls the car to the lobby. In FIG. 1, the floors 2–13, above the main floor or lobby, are divided into three sectors, each sector containing four floors. The sectors are contiguous and each of the sectors is served by only one of the four cars 1–4 at any one time; leaving one car, e.g., car 1, free. One channeling routine according to the prior art ('019 patent) is disclosed in FIGS. 2A–2C herein, in which N=number of sectors, NC=number of cars, SN is the sector number while CN is the car number. Each car 1–4 will only respond to car calls that are made in the car from the lobby to floors that coincide with the floors in the sector assigned to the car. The car 4, for instance, will only respond to car calls made at the lobby to the floors 10–13. The car will take passengers from the lobby to those floors (10–13) (provided car calls are made to those floors) and then return to the lobby empty, unless it is assigned, using other dispatching sequences or routines, to answer an up or down hall call that has been made on one of the floors. See, for example, such other dispatching sequences or routines which are accessed during the up-peak (channeling) condition: U.S. Pat. No. 4,363,381 to Bittar, Relative System Response Call Assignments, and U.S. Pat. No. 4,323,142 to Bittar, Dynamically Reevaluated Elevator Car Call Assignments, which are all hereby incorporated in their entireties by reference.

Figure 3:
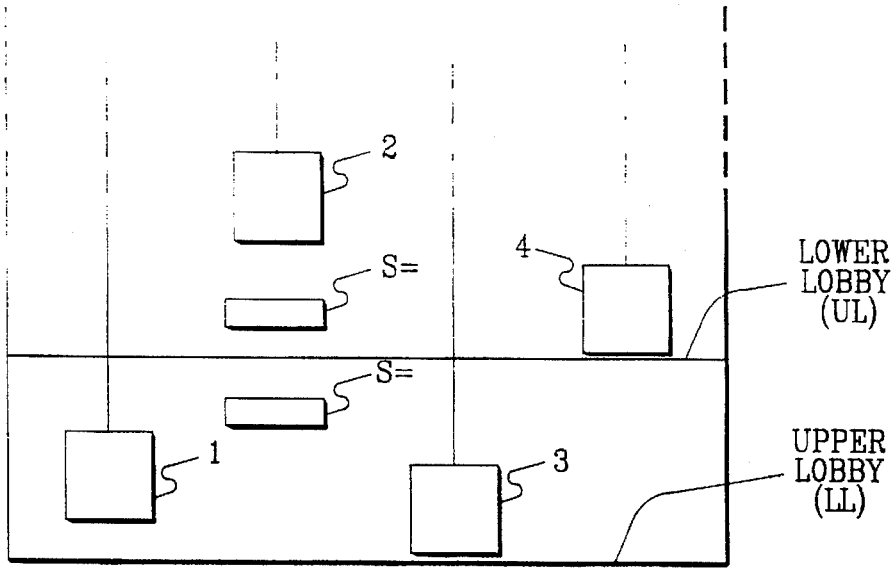
FIG. 3 is a schematic block diagram of the elevator system of FIG. 1 modified to serve upper and lower lobbies, in which the present invention is implemented.
Figure 4A:
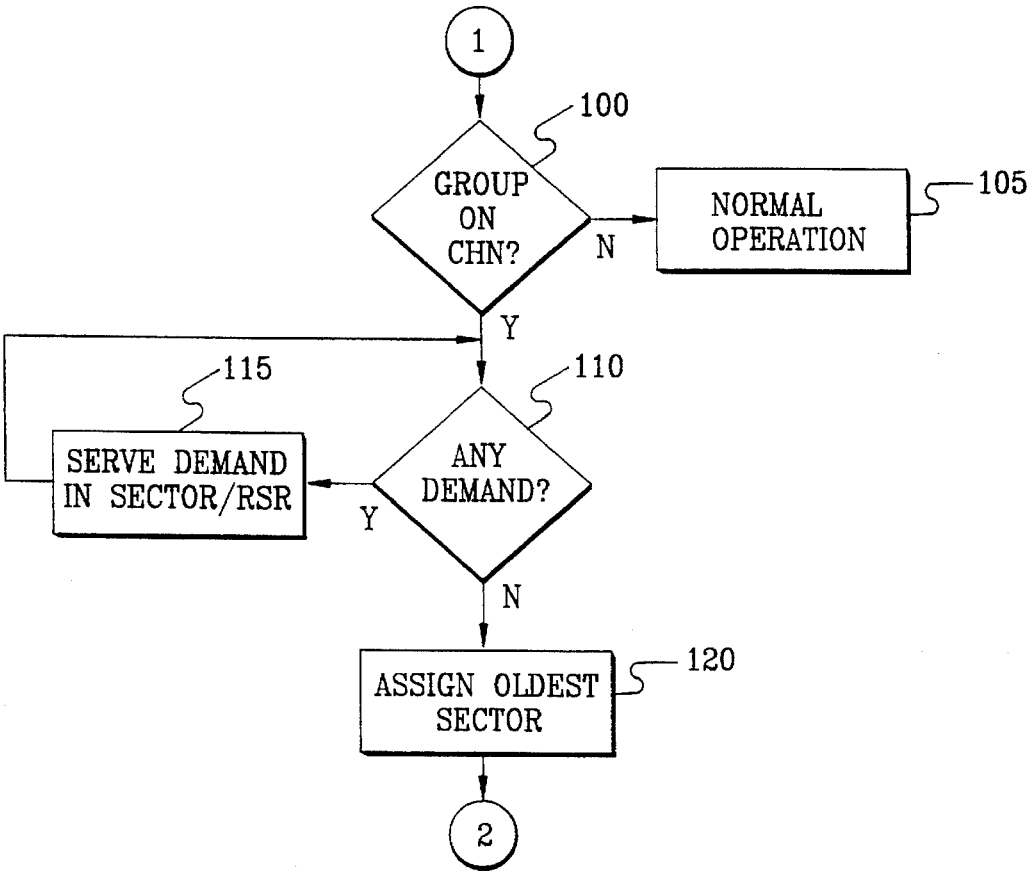
FIGS. 4A, 4B and 4C are high level logic flow diagrams showing a preferred dual lobby routine according to the present invention, which may be implemented to interact with any known channeling routine such as that of FIGS. 2A–2C.
Figure 4B:
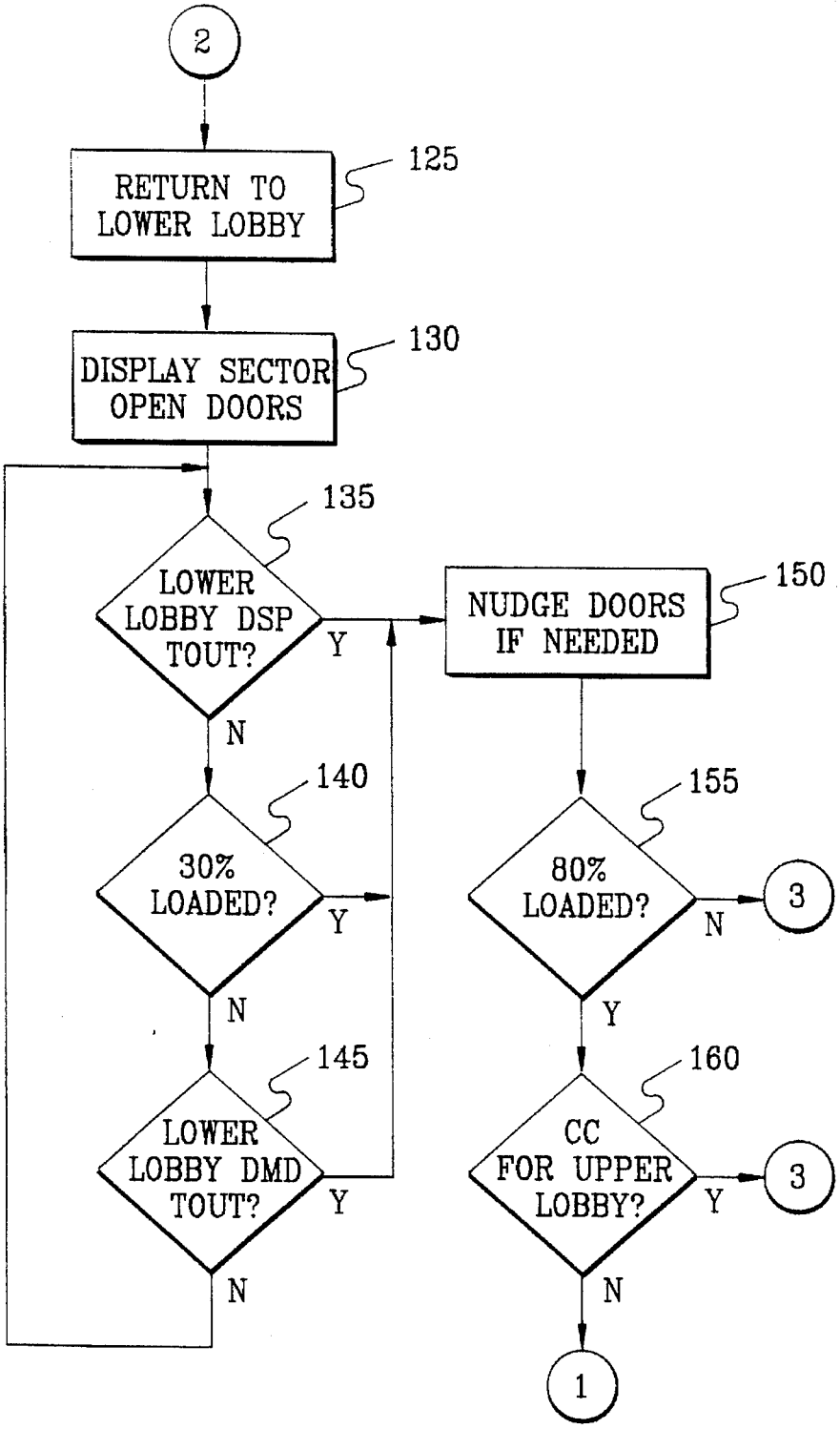
Figure 4C:
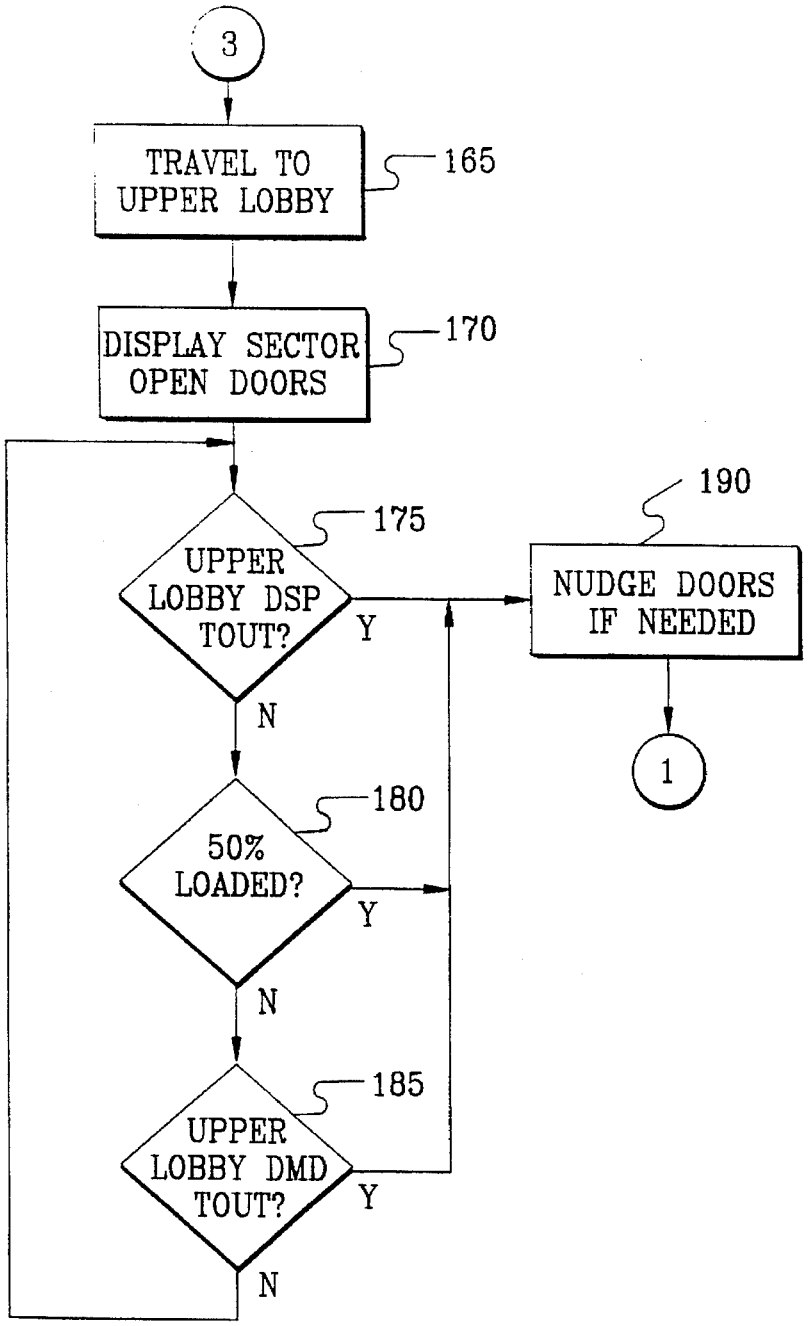
Figure 7:
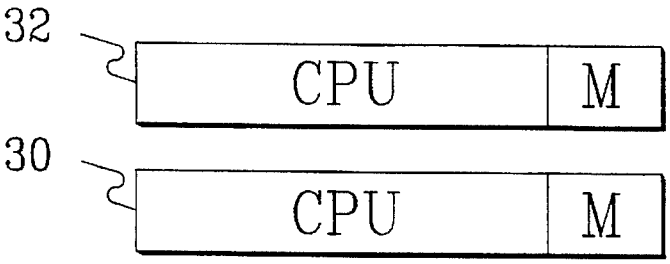
FIG. 7 shows schematic block diagrams of controllers each having a respective CPU coupled to a respective memory M.
Figure 6B:
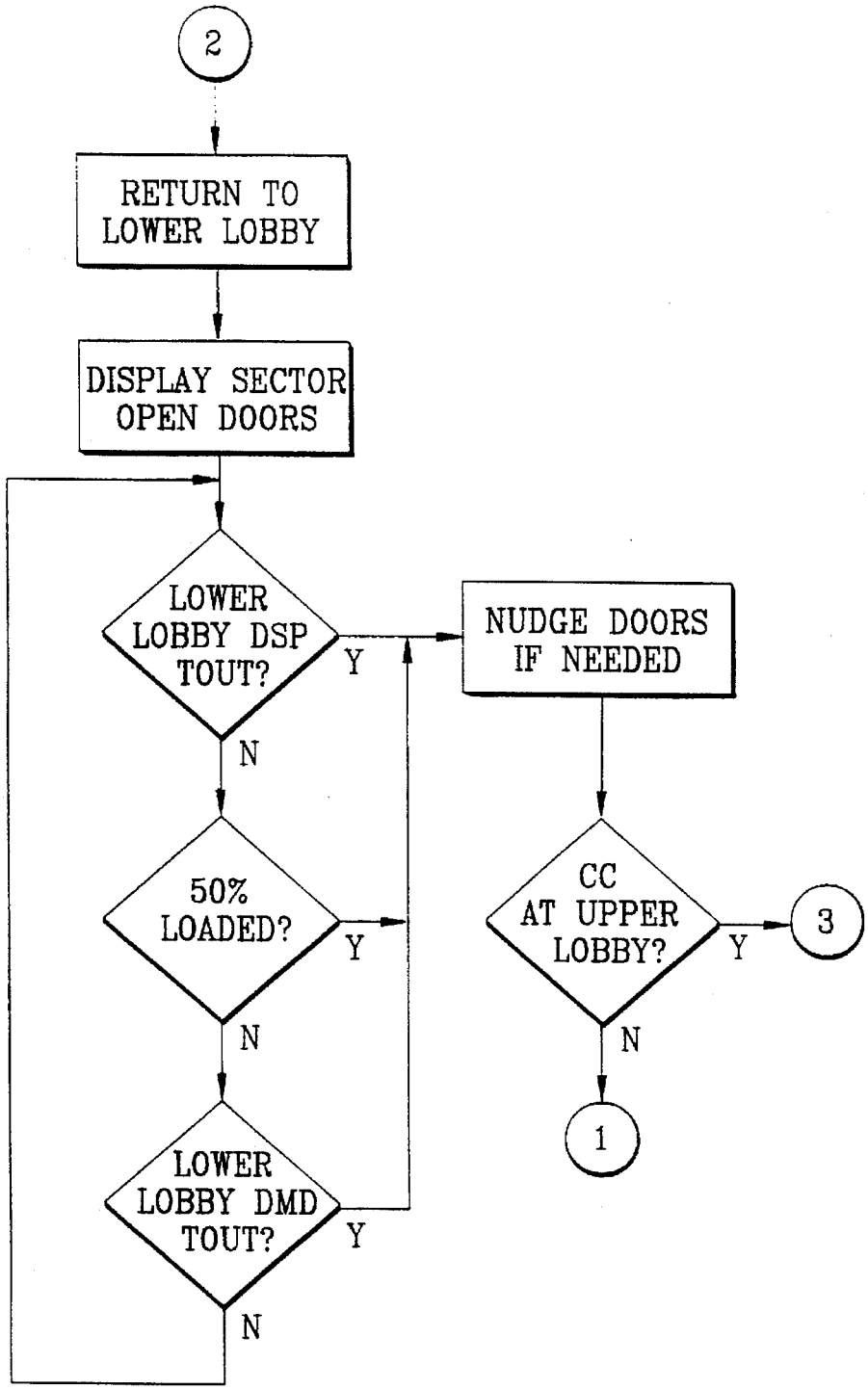
Figure 6C:
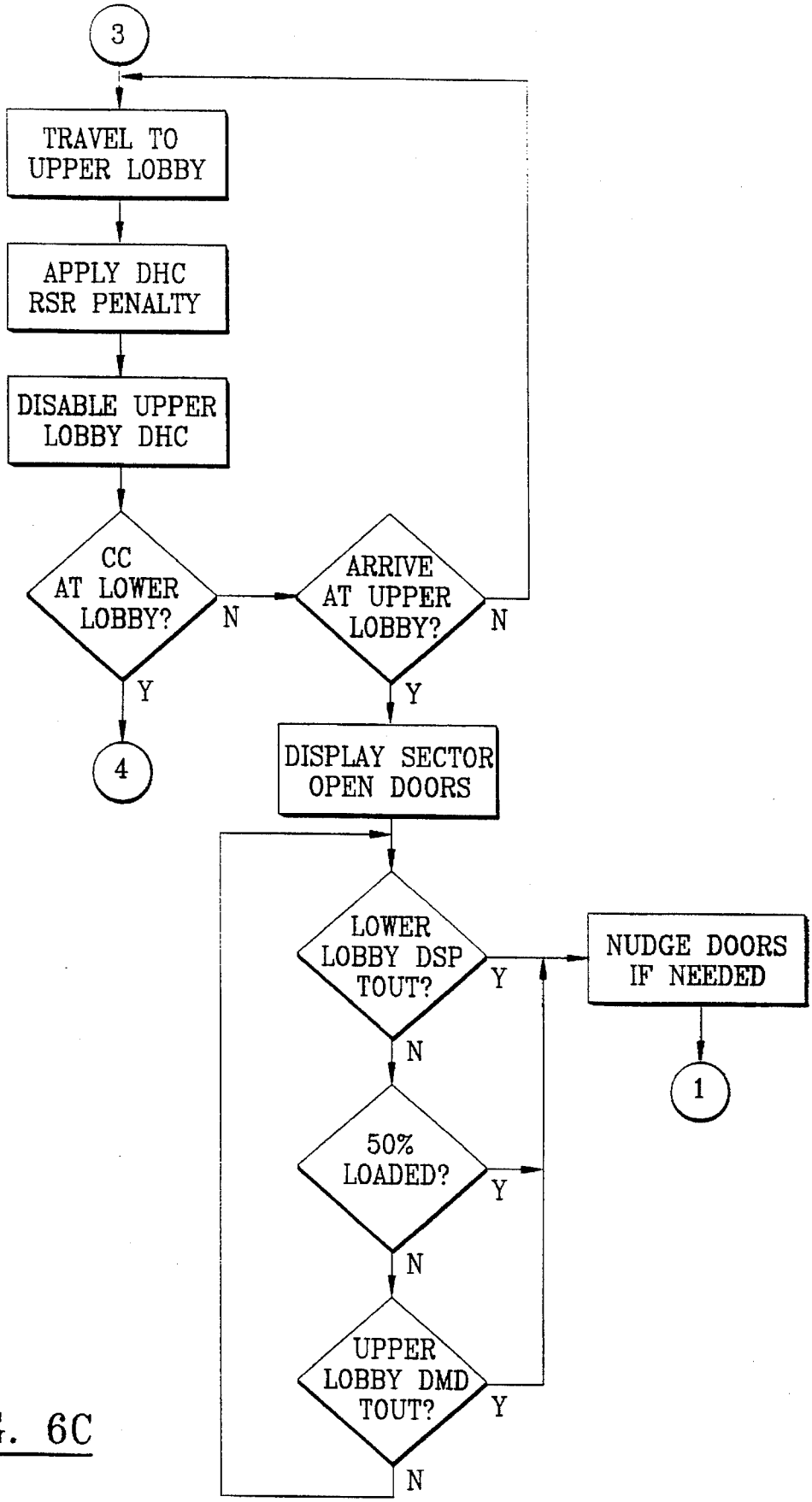
Figure 6D:
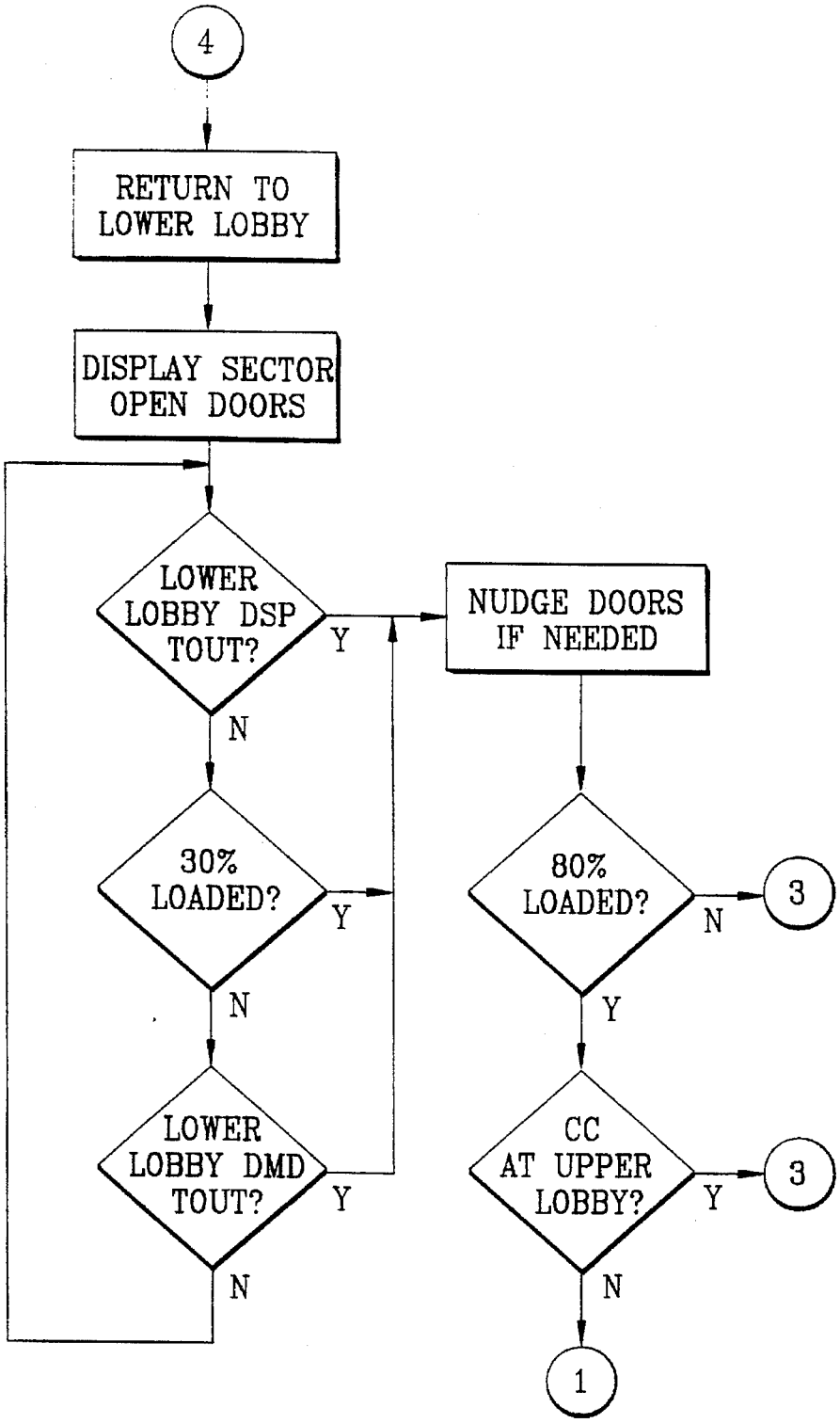

To implement the instant invention as shown in FIGS. 4A–4C for the dual lobby situation of FIG. 3, each car 1–4 is connected to a drive and motion control 30. Each of these motion controls 30 is connected to a group controller 32. Although it is not shown, each car's position in the building would be served by the controller through a position indicator as shown in the previous patent '142 to Bittar. The controls 30,32 contain CPUs (central processing units or signal processors) for executing instructions, and for processing data from the elevator system. Respective instructions and data are stored, e.g., in well known fashion in respective memories M of the controller 30,32; see FIG. 7. The group controller 32, using signals from the drive and motion controls 30, sets the sectors that will be served by each of the cars. Each motion control 30 receives the HC and CC signals and provides a drive signal to the service indicator SI. Each motion control also receives data from the car that it controls on the car load via LW (Load Weight) signal. It also measures the lapsed time while the doors are open at the lobby (the "dwell time", as it is commonly called). The drive and motion controls and group controls are shown in a very simplified manner herein because numerous patents and technical publications showing details of drive and motion controls and group controllers for elevators are available. See an alternative group control arrangement as shown and described in U.S. Pat. No. 5,202,540 which is hereby incorporated in its entirety by reference. It is assumed therefore that the CPUs in the controllers 30,32 are suitably programmable to carry out the routines described herein to effect the dual lobby dispatching operation of this invention at a certain time of day (e.g., up-peak) or under settled building conditions, and it is also assumed that at other times the controllers are capable of accessing or calling different dispatching routines, for instance, the routines shown in the aforementioned Bittar patents. This system can collect data on individual and group demands throughout the day to arrive at a historical record of traffic demands for each day of the week and compare it to actual demand to adjust the overall dispatching sequences to achieve a prescribed level of system and individual car performance.

Following such an approach, car loading and lobby traffic may also be analyzed through a signal LW, from each car, that indicate the car load. Actual lobby traffic may also be sensed by using a people sensor (not shown) in the lobby. U.S. Pat. No. 4,330,836 to Donofrio et al. on an "Elevator Cab Load Measuring System" and U.S. Pat. No. 4,303,851 to Mottier on a "People and Object Counting System", both assigned to Otis Elevator Company, show approaches that may be employed to generate those signals. Using such data and correlating it with the time of day and the day of the week and the actual entry of car calls and hall calls, a meaningful demand demograph can be obtained for allocating the sectors throughout the up-peak period by using a signal processing routine that implements the sequences described on the flow chart comprising FIGS. 2A–B in order to minimize the waiting time from the upper lobby.

According to the invention as shown in FIG. 3 and FIGS. 4A–4C, a dual lobby program controls the elevator cars in the group to serve an upper lobby and a lower lobby, in order to minimize waiting times from the lower and upper lobbies. The dual lobby routine is stored, for example, in any appropriate memory M of the group controller 32 (e.g., ROM/EEPROM etc.) or of an operational control subsystem (not shown) of any other controller such as that shown and described in previously incorporated U.S. Pat. No. 5,202,540. The routine of FIGS. 4A–4C can interact with any of the known channeling routines at any appropriate locations in the known routines, which locations are matters of design choice. For example, the dual lobby routines of FIGS. 4A–4C can be entered between steps S7, S8 and exited between steps S16 and S17 of FIGS. 2A–2C.

As shown in routine of FIG. 4A according to the invention, is the group on channeling, step 100, if NO, proceed to normal operation such as known RSR routines, step 105. If YES in step 100, any demand for the car (such as from car calls) step 110; if YES, proceed to step 115. If NO in step 110, proceed to step 120 which will assign a sector (e.g., oldest) to the car according to, for example, a step identical to the step S9 of the known channeling routine of FIG. 2A. The "oldest" sector is, for example, the most aging sector—sector having longest period since last assigned a car. After a sector is assigned in step 120, the car continues to proceed to the lower lobby (LL) at which lower lobby it displays or otherwise indicates its sector assignment and opens its doors, steps 125 and 130. Thereafter, the car remains at the lower lobby until a contracted period of time has expired (lower lobby dispatching time-out), step 135, or the car's capacity has exceeded a pre-defined threshold, for example 30% of full a capacity, step 140, or a lower lobby demand time-out is exceeded, step 145. If any of the steps 135, 140, 145 is YES, the car will attempt to close its doors and proceed to the upper lobby—nudge doors if needed, step 150. Nudging is defined as controlling the car doors (with reversal disabled) such that they begin to close at a reduced and safe speed after a predetermined time period (e.g., 20 seconds).

If the car has reached a certain capacity (e.g., 80% of full capacity) at the lower lobby, the car will not stop at the upper lobby to pick-up more passengers unless it has a coincident car call at the upper lobby, steps 155, 160. If NO in step 155 or YES in step 160, the car will stop at the upper lobby, step 165, display or otherwise indicate its sector assignment and then open its doors, step 170. The car will remain at the upper lobby until a contracted time period has expired (upper lobby dispatching time-out?—step 175), or its capacity has exceed another predefined threshold, (for example, 50% of full capacity—step 180), or an upper lobby demand time-out is exceeded, step 185. In this case, demand is a car call registered from the car. Upper lobby demand time-out is defined as, e.g., the car remained at the upper lobby beyond a pre-defined time period. At a minimum, the car remains at the upper lobby for, for example, five seconds prior to serving a landing in its assigned sector. If any of the steps 175, 180, 185 is YES, nudge doors if needed, step 190.

If a car assigns itself to a sector while at the lower lobby and does not receive any demand (car call) after a specified time-out (step 145), the car will travel to the upper lobby in an attempt to serve demand within its assigned sector. If the car does not have any demand at the upper lobby after a specified time-out (step 185), the car will be de-assigned from its sector and return to the lower lobby to serve a new sector steps 120, 125.

It should be understood that in step 130, for example, a sector assignment need not be visually displayed, but can be indicated in any suitable manner to a passenger such as by audio or other means. See, for example, U.S. patent application Ser. No. 08/222,135, filed Apr. 1, 1994, by Bok S. Ng, assigned to Otis Elevator Company, which is hereby incorporated in its entirety by reference. The U.S. application '135 discloses an audio direction and information system for elevator passengers. A speaker system is provided adjacent to a gate of each of a plurality of elevator cars in each floor of a building. The speaker systems announce messages such as the car number of the next car in either direction, an estimated time of arrival of the car, that the car is full, an approximate delay for service by a next car to come, a car number and floor numbers being served by each loading elevator during up-peak with channeling. Speaker systems are put on the doors of each stairwell on every floor, thereby to direct passengers toward the stairs in case of an emergency. The system not only provides information and identification, but also provides audible directional cues to assist the passengers in locating the service which they are to seek.

Figure 5B:
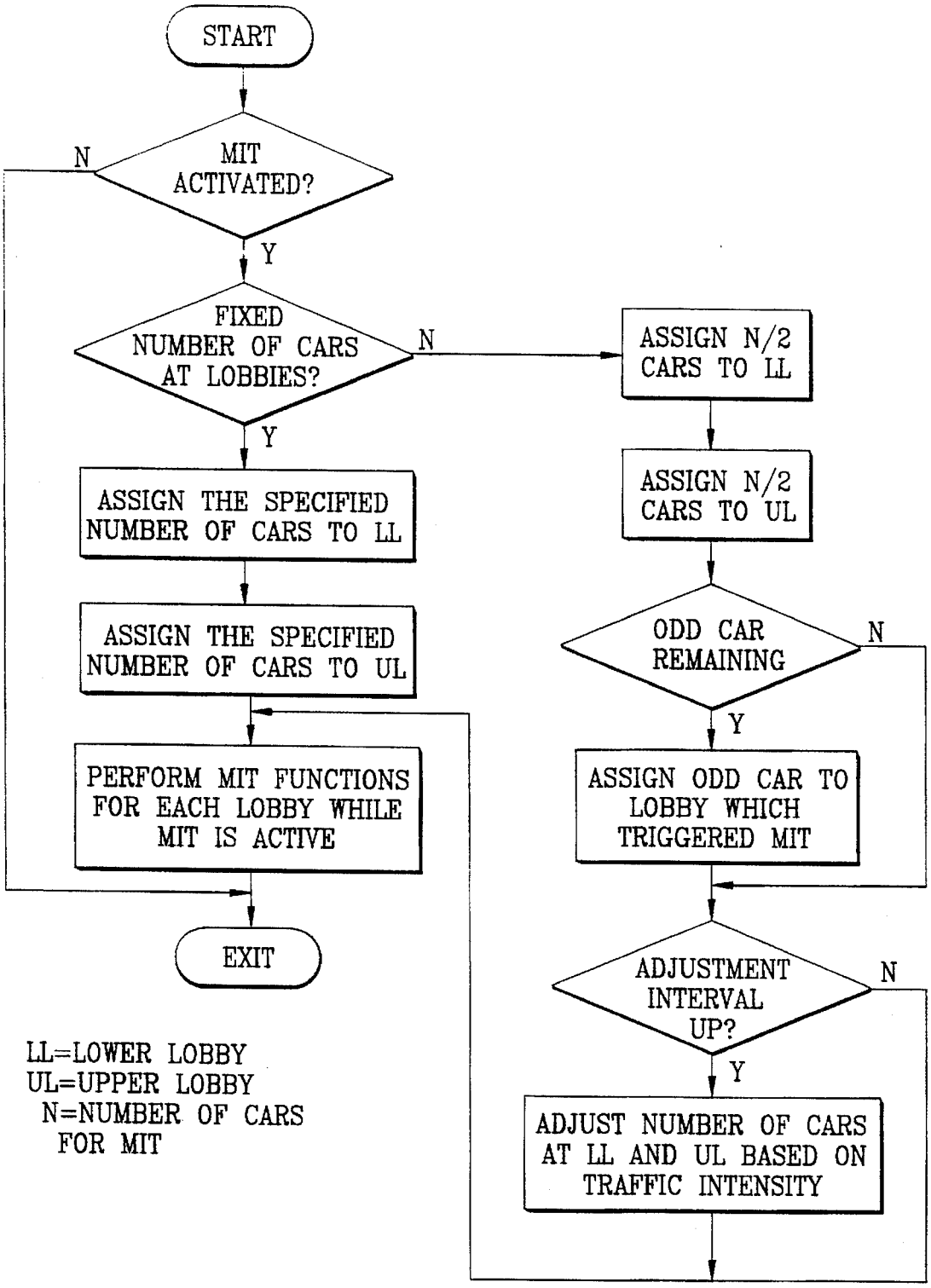
FIG. 5B is a high-level logic flow diagram which effects the routine of FIG. 5A.
Figure 6A:
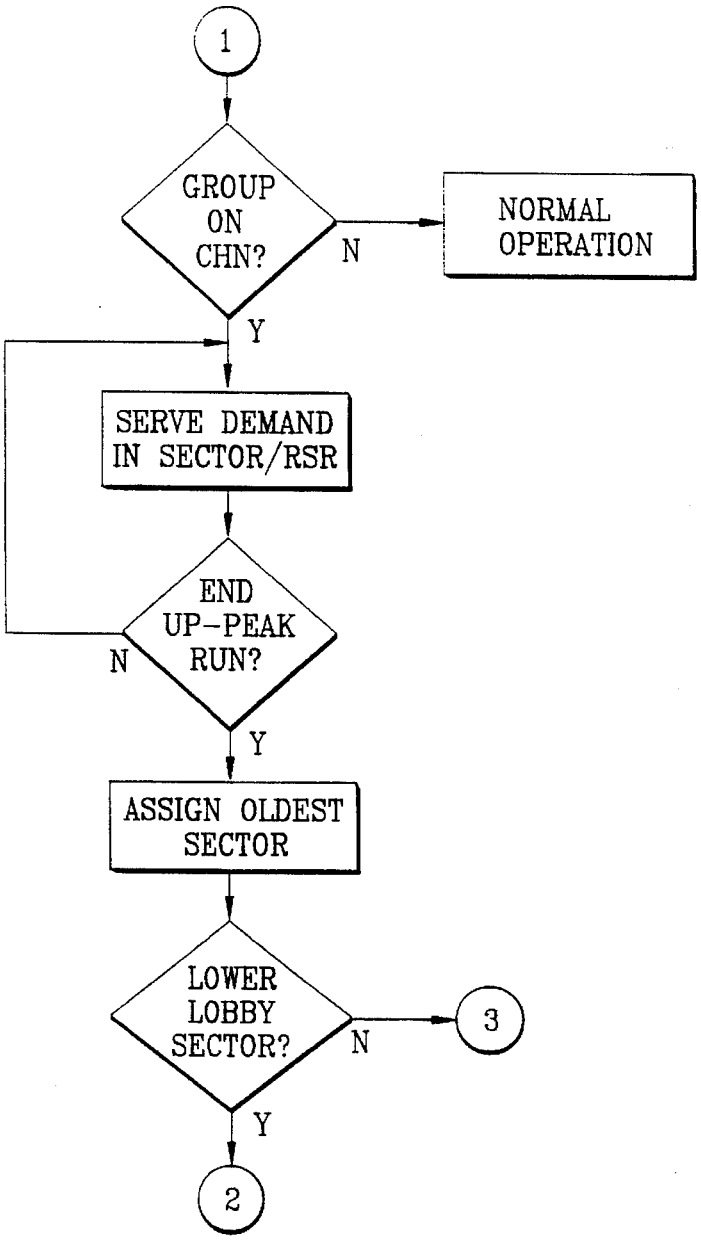
FIGS. 6A–6D are high-level logic flow diagrams showing a second alternative embodiment of the dual lobby routine according to the invention.

Alternative dual lobby routines which embody principles of the present invention are shown, for example, in the steps of FIGS. 5A–5B herein and, for example, in the steps of FIGS. 6A–6D herein.

While there has been shown and described what is at present considered preferred embodiments of the present invention, it will be apparent to those skilled in the art that various changes and modifications may be made therein without departing from the spirit and scope of the present invention which shall be limited only by the appended claims.

What is claimed is:

1. An elevator system, comprising:

a controller having an electronic processor coupled to a memory;

a plurality of elevator cars controllably connected to said controller, a dual lobby routine stored within said memory, said dual lobby routine including instructions for dispatching at least one of said elevator cars to a lower lobby during up-peak, indicating a sector assigned to said car, dispatching said car to the upper lobby if a first load weight threshold is exceeded and a second load weight threshold is not exceeded or if a car call to the upper lobby is registered, and then indicating the sector assigned to said car while said car is located at the upper lobby, said second load weight threshold being equal to at least two times said first load weight threshold, and wherein said instructions further include instructions for nudging doors of said at least one elevator car closed prior to dispatching said car to the upper lobby.

* * * * *